United States Patent [19]

Denny et al.

[11] 4,385,502

[45] May 31, 1983

[54] DEFROST CONTROL DEVICE AND METHOD OF OPERATING SUCH

[75] Inventors: Dann W. Denny; Ronald L. Hilty; Paige W. Thompson, all of Morrison, Ill.

[73] Assignee: General Electric Company, Fort Wayne, Ind.

[21] Appl. No.: 297,103

[22] Filed: Aug. 28, 1981

[51] Int. Cl.[3] ..... F25D 21/06

[52] U.S. Cl. ..... 62/155; 74/335; 200/38 R; 307/117

[58] Field of Search ..... 307/141, 117; 74/335; 200/38 B, 39 R, 38 R; 62/155, 156

[56] References Cited

U.S. PATENT DOCUMENTS

| | | | |
|---|---|---|---|
| 2,949,017 | 8/1960 | Swanson | 62/155 |
| 3,319,019 | 5/1967 | Jullien-Davin | 200/38 R |
| 3,573,486 | 4/1971 | Harris | 307/116 |
| 3,828,199 | 8/1974 | Sakai et al. | 307/141 |

*Primary Examiner*—A. T. Grimley
*Assistant Examiner*—Morris Ginsburg
*Attorney, Agent, or Firm*—Joseph E. Papin

[57] ABSTRACT

A defrost control device has camming means for rotational movement and gear train means operable generally in a pair of preselected speed modes for effecting the rotational movement of the camming means. Means actuated by the camming means during a part of the rotational movement thereof toward a displaced position is adapted for translating the gear train means from one of the preselected speed modes to the other of the preselected speed modes thereof. Means is selectively operable upon the occurrence of a preselected condition for releasably maintaining the translating means in the displaced position thereof to effect the operation of the gear train means in its other preselected speed mode.

A method of operating a defrost control device is also disclosed.

29 Claims, 13 Drawing Figures

DEFROST CONTROL DEVICE AND METHOD OF OPERATING SUCH

FIELD OF THE INVENTION

This invention relates in general to conditioning systems, such as those utilized with heat pumps or the like for instance, and inparticular to a defrost control device therefor and a method of operating a defrost control device.

BACKGROUND OF THE INVENTION

In the past, various different methods and devices have been utilized to initiate and control a defrost cycle for a conditioning system, such as for instance that associated with a heat pump or the like. A heat pump is selectively reversibly utilized in a cooling mode to remove heat from a preselected indoor space during the summer and in a heating mode to effect the heating of such space in the winter. For instance, heat pumps are provided with an indoor heat exchanger and an outdoor heat exchanger with a compressor reversibly interconnected therebetween. Thus, when the heat pump is in the cooling mode thereof, the indoor heat exchanger operates as an evaporator, and when the heat pump is in the heating mode thereof, the outdoor heat exchanger operates as an evaporator. Fans may be employed in the heat pump to circulate indoor air over the indoor heat exchanger and outdoor air over the outdoor heat exchanger, respectively, during either the cooling mode operation of the heat exchanger or the heating mode operation thereof.

When the heat pump is being operated in the heating mode thereof, the occurrence of certain conditions, such as atmospheric or outside temperature and high humidity or the like for instance, may cause the accumulation of frost on the outdoor heat exchanger of the heat pump. Of course, such an accumulation of frost on the outdoor heat exchanger inhibits heat transfer between the outdoor heat exchanger and the outdoor air being circulated thereover which serves to reduce the efficiency of the heat pump. Furthermore, it is believed that if a frost layer is permitted to accumulate without interruption on the outdoor heat exchanger, the compressor motor of the heat pump and/or other components thereof might be damaged; therefore, various schemes have been employed in the past to effect defrosting of the outdoor heat exchanger of the heat pump.

For instance, in the heating mode operation of the past heat pumps, various devices were utilized in an attempt to correlate conditions, such as for instance outside atmospheric temperature, outside heat exchanger temperature, and refrigerant temperature in the outside heat exchanger, all of which may be indicative of frost accumulation, in order to measure or otherwise ascertain frost build-up on the outdoor heat exchanger of such past heat pumps. When these sensing devices were operative to indicate a need for effecting defrosting of the accumulated frost in the outdoor heat exchanger, the past heat pumps were reversed so as to effect heating of the outdoor heat exchangers in an attempt to reduce the accumulated frost thereon, and with some of such past heat pumps, an auxiliary heating system was energized to effect heating of the preselected indoor space thereby to counteract the air conditioning or cooling of such preselected space by the heat pump upon the reversal thereof to reduce the frost on the outdoor heat exchanger. Of course, when the outdoor heat exchanger of the past heat pumps was being heated to rid it of accumulated frost, it is believed that any fan circulating outdoor air over the outdoor heat exchanger was deenergized.

SUMMARY OF THE INVENTION

Among the several objects of the present invention may be noted the provision of an improved defrost control device and an improved method of operating a defrost control device; the provision of such improved defrost control device and method in which defrost cycle time of a preceding defrost period is determinative of a following period during which defrost is inhibited; the provision of such improved defrost control device and method having a time override for terminating a defrost cycle; the provision of such improved defrost control device having means for manually advancing it; the provision of such improved defrost control device and method which reduce the frequency of defrost cycles at low outdoor temperatures; and the provision of such improved defrost control device and method utilizing component parts which are simple in design, easily assembled and economically manufactured. These as well as other objects and advantageous features of the present invention will be in part apparent and in part pointed out hereinafter.

In general, a defrost control device in one form of the invention has cammimg means for rotational movement and gear train means operable generally in a pair of preselected speed modes for effecting the rotational movement of the camming means. Means actuated by the camming means during a part of the rotational movement thereof toward a displaced position is adapted for translating the gear train means from one of the preselected speed modes to the other of the preselected speed modes thereof. Means is selectively operable upon the occurrence of a preselected condition for releasably maintaining the translating means in the displaced position thereof to effect the operation of the gear train means in its other preselected speed mode.

Also in general and in one form of the invention, a method is provided for operating a defrost control device having gear train means for operation in a pair of preselected speed modes and also having a camming means associated with the gear train means for rotational movement thereby. In this method, the gear train means is operated in either of the preselected speed modes thereof, and the rotational movement of the camming means is effected. The association between the camming means and the gear train means is interrupted, and the rotational movement of the camming means is terminated upon each revolution thereof. The camming means is reset in the association thereof with the gear train means subsequent to the interruption of the association therebetween, and the rotational movement of the camming means is adapted to be reinitiated when the camming means is reset in the association thereof with the gear train means.

BRIEF DESCRIPTION OF THE DRAWINGS

Corresponding reference characters indicate corresponding parts throughout the several views of the drawing.

The exemplifications set out herein illustrate the preferred embodiment of the invention in one form thereof, and such exemplifications are not to be construed as limiting either the scope of the invention in any manner.

DETAILED DESCRIPTION OF THE PREFERRED EMBODIMENT

With reference to the drawings in general, there is illustrated a method in one form of the invention of operating a defrost control device 21 having drive or gear train means 23 for operation in at least a pair of preselected speed modes and also having camming means 25 associated with the gear train means for rotational movement thereby (FIGS. 1–3 and 7). In this method, gear train means 23 is operated or otherwise driven or actuated in either of the preselected speed modes thereof, and the rotational movement of camming means 25 is effected or otherwise controlled thereby (FIGS. 7–12). The association between camming means 25 with gear train means 23 is interrupted, and the rotational movement of the camming means is terminated upon each revolution thereof (FIGS. 1–4 and 7–12). Camming means 25 is reset or otherwise replaced in the association thereof with gear train means 23 subsequent to the interruption of the association therebetween, and the rotational movement of the camming means is adapted to be reinitiated or otherwise reestablished when the camming means is reset in the association thereof with the gear train means (FIGS. 1–4 and 7–12).

Figure 7:
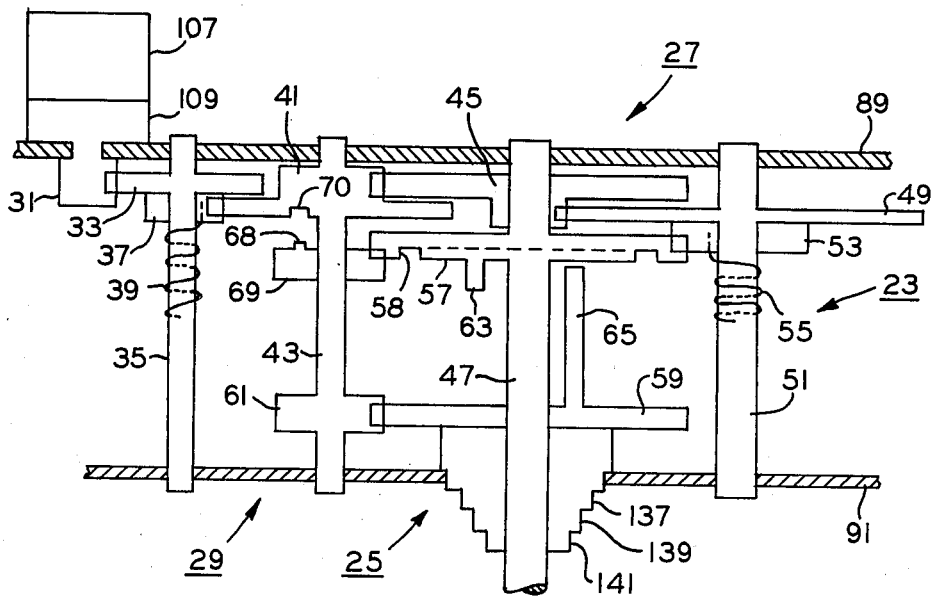
FIG. 7 is a schematic diagram illustrating a gear train for the defrost control device as shown at least in part in FIGS. 2–5.

More particularly and with specific reference to FIG. 7 gear train or gear train means 23 is provided with a pair of gear train branches, indicated generally at 27, 29, which are respectively operable in the preselected speed modes of the gear train for driving association with camming means 25. Assuming that camming means 25 is interconnected in the driven association thereof with gear train branch 27 in the one of the preselected speed modes, i.e., a slow or low speed mode, of gear train 23, a motor driven pinion or input pinion means 31 is drivingly meshed in engagement with an idler gear 33 of a shaft 35, and a clutch device or one-way clutch mechanism, such as a clutch gear 37 and a clutch or coil spring 39, for instance, are rotatably disposed about or on shaft 35 so that the clutch gear is conjointly rotatable with the idler gear and the shaft in only one direction of rotation thereof. Thus, when idler gear 33 and shaft 35 are conjointly rotatably driven by motor pinion 31, clutch spring 39 is tightened about the shaft thereby to urge, clutch or otherwise effect the conjoint rotation of the clutch gear with the idler gear and shaft in the one direction of rotation thereof; however, if the clutch gear is rotatably driven about the shaft in another direction opposite the aforementioned one direction, the clutch spring will loosen or slip about the shaft so as to interrupt the conjoint rotation between the idler and clutch gears thereby to release the conjoint or driving rotational engagement between the idler and clutch gears, as discussed hereinafter. Clutch gear 37 is meshed in engagement with a double reduction gear 41 of a shaft 43, and in turn reduction gear 41 is meshed in engagement with another double reduction gear 45 rotatably carried about another shaft 47. Reduction gear 45 is meshed in engagement with another idler gear 49 carried on a shaft 51, and another clutch device or one-way clutch mechanism, such as a clutch gear 53 and a clutch or coil spring 55 for instance, is rotatably disposed about or on shaft 51 so that the clutch gear is conjointly rotatable with the idler gear and shaft in only one direction of rotation thereof. Thus, when idler gear 49 and shaft 51 are conjointly rotatably driven by reduction gear 45, clutch spring 55 is tightened in gripping engagement about the shaft thereby to urge, clutch or otherwise effect the conjoint rotation of the clutch gear with the idler gear and shaft in the one direction of rotation thereof; however, if the clutch gear is rotatably driven about the shaft in another direction oposite the aforementioned one direction thereof, the clutch spring will loosen or slip about the shaft so as to interrupt the conjoint rotation between the idler and clutch gears thereby to release at least a part of gear train 23, such as the idler gear and reduction gear 45 for instance as discussed hereinafter.

Figure 5:
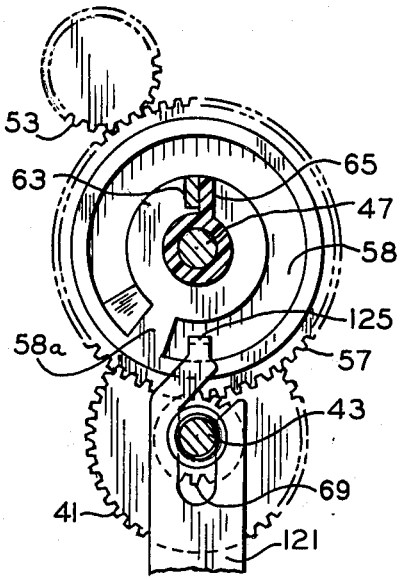

A driven pinion gear 57 is carried on shaft 47 so as to be conjointly rotatable therewith and also meshed in engagement with clutch gear 53, and a segmented or sector gear 59 is rotatably disposed about shaft 47 and meshed in engagement with another gear or gear means 61 carried on shaft 43. Driven pinion gear 57 is also provided with a generally circular cam groove 58 and land **58*a* therein, as also shown in FIG. 5 and as discussed hereinafter. Segmented gear 59 and camming means 25 are suitably interconnected so as to be conjointly rotatable with each other, and shaft 47** extends through the segmented gear and camming means so as to be journaled by the camming means.

Figure 4:
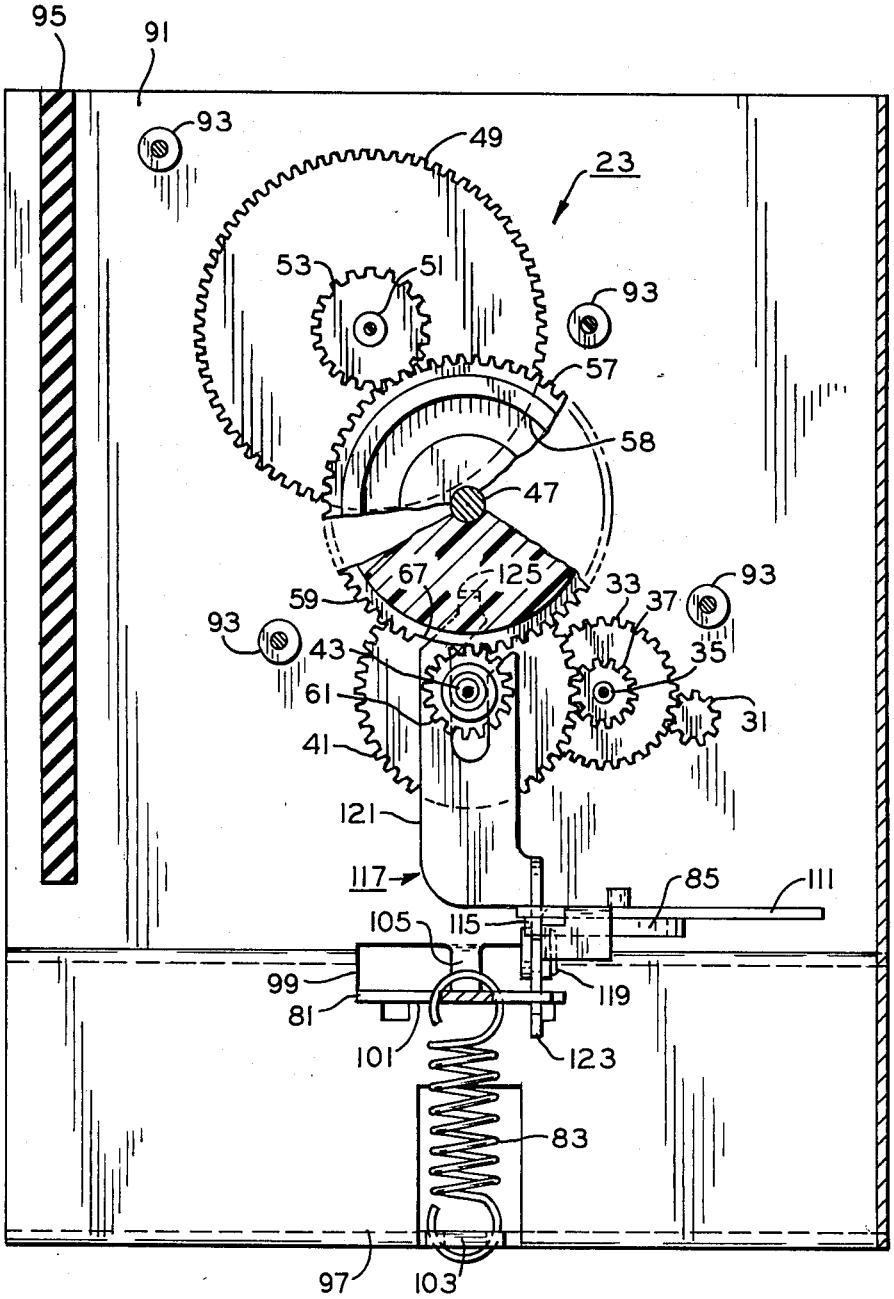
FIGS. 4, 5 and 6 are sectional views taken along lines 4—4, 5—5 and 6—6 of FIG. 2, respectively, and illustrate principles which may be utilized in a method of operating the defrost control device also in one form of the invention.

It may be noted that pinion gear 57 and segmented gear 59 have a pair of means, such as abutments or extensions 63, 65 for instance, respectively associated or otherwise arranged so as to be conjointly rotatable therewith and adapted for engagement or abutment with each other so as to effect conjoint rotation of the segmented gear with the driven pinion gear at least during the slow speed mode operation of gear train branch 27. It may also be noted that segmented gear 59 has a sector 67 with a plurality of missing gear teeth, as best seen in FIG. 4, and when the sector is presented to gear 61, i.e., run out of meshing engagement therewith, the rotational movement of camming means 25 is, of course, terminated during each revolution thereof with the segmented gear unless abutments 63, 65 associated with pinion gear 57 and the segmented gear are in driving abutting engagement with each other during the slow speed mode operation of gear train 23, as discussed hereinafter.

In view of the foregoing when gear train 23 is operated in the slow speed mode thereof, slow speed branch 27 is driven by motor pinion 31 through idler gear 33, clutch gear 37, reduction gears 41, 45, idler gear 49, clutch gear 53, driven pinion 57 and segmented gear 59, and in the event that abutments 63, 65 of the driven pinion and segmented gear are separated from each other upon the initiation of the operation of the slow speed branch, then it may be noted that the driven pinion is rotated or otherwise driven relative to the segmented gear until the abutments are moved into engagement with each other. Thereafter, with abutments 63, 65 engaged, as mentioned above, segmented gear 59 is conjointly rotated by driven pinion gear 57 during the operation of slow speed branch 27 of gear train 23.

Figure 2:
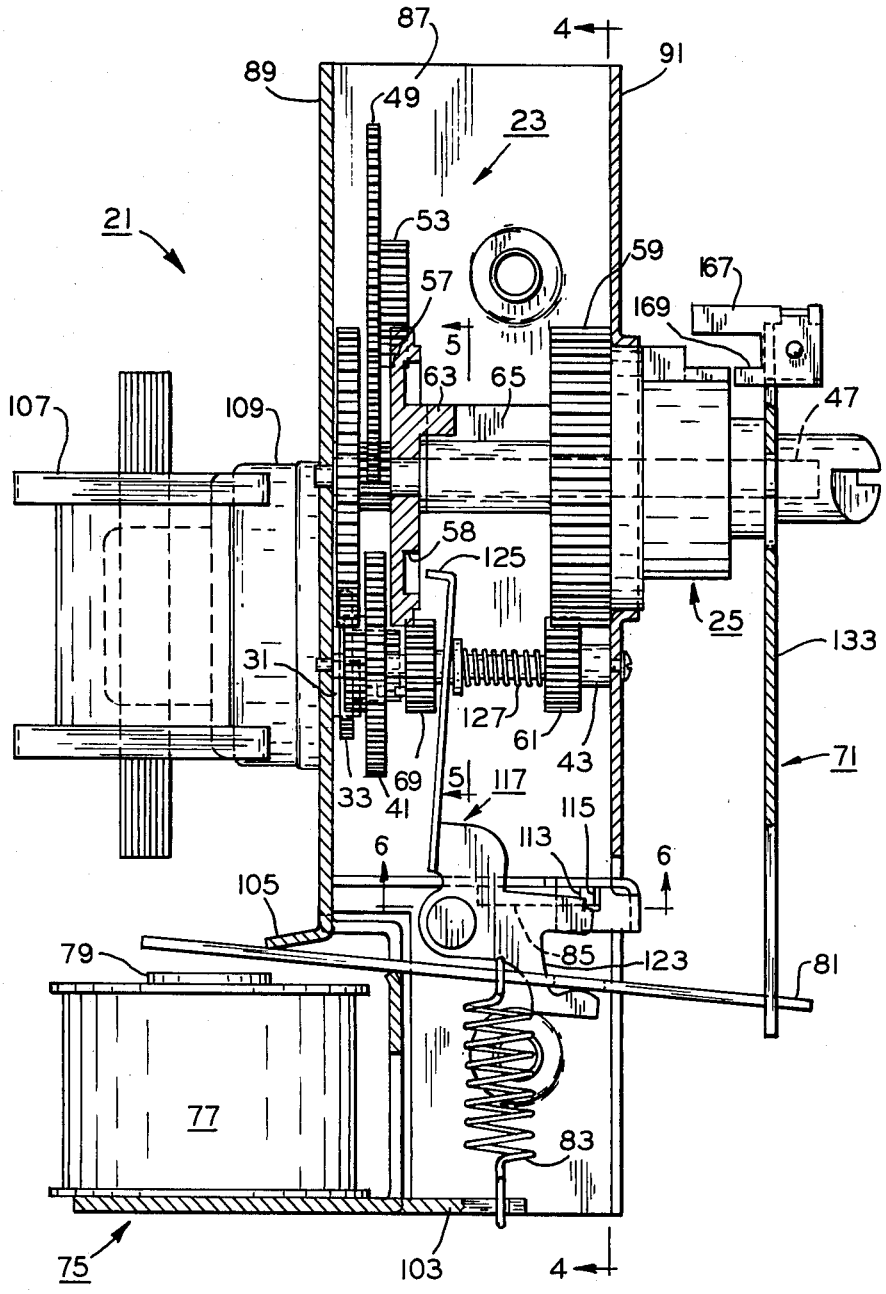
FIG. 2 is a sectional view taken along lines 2—2 of FIG. 1.
Figure 3:
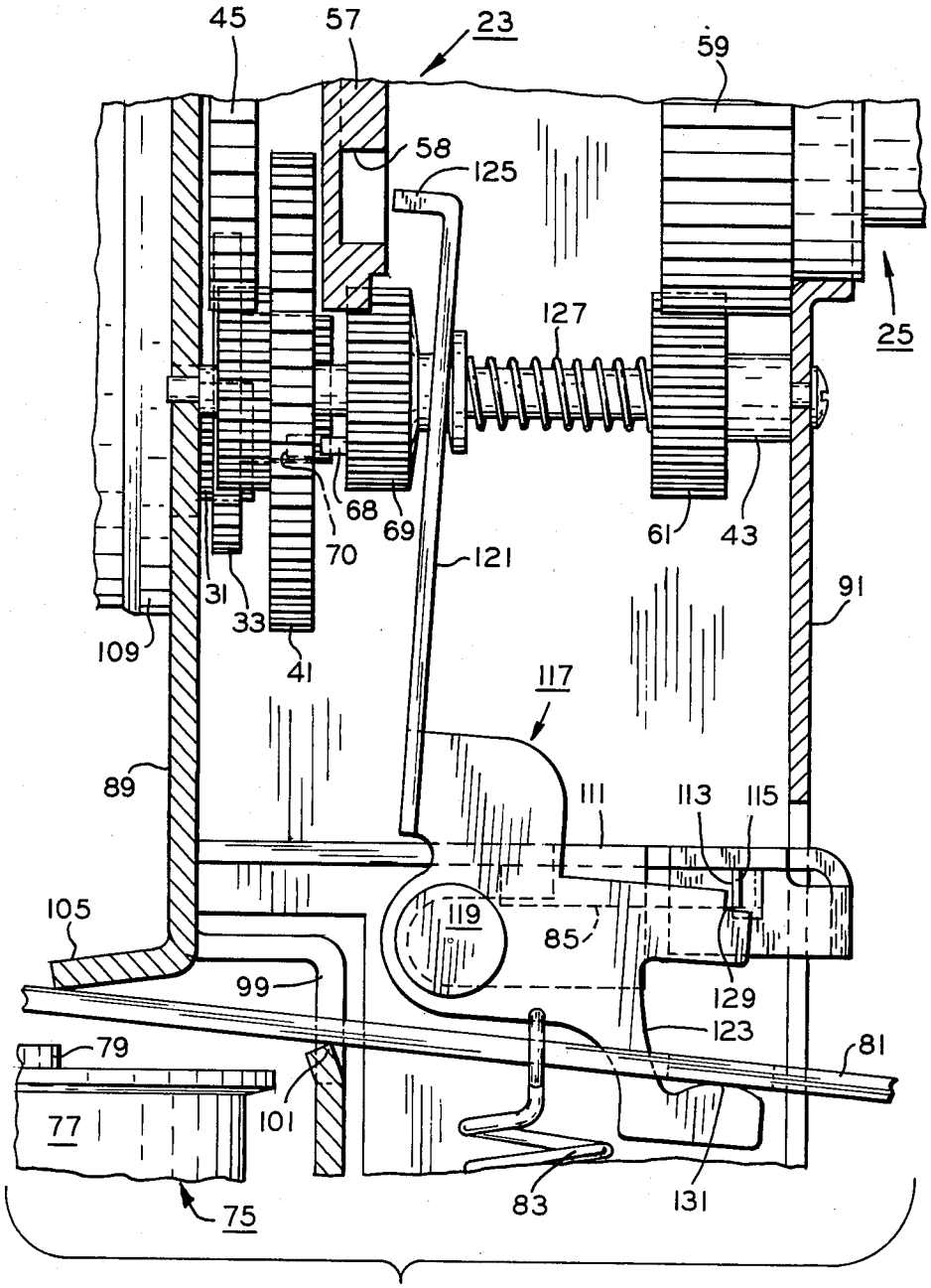
FIG. 3 is an enlarged partial view taken from FIG. 2.

Means, such as shifting gear 69, is provided for shifting gear train 23 from the slow speed mode to the other of the preselected speed modes, i.e., a fast or high speed mode, thereof as also illustrated in FIGS. 2 and 3. Shifting gear 69 is axially movable on shaft 43 between an at-rest position and a displaced or operative position in driven engagement with reduction gear 41 and meshed in engagement with driven pinion gear 57. When shifting gear 69 is translated or axially moved from its at-rest position into its displaced position, a plurality of means, such as hubs or extensions 68 or the like for instance carried on the shifting gear and cooperating recesses 70 or the like for instance provided in reduction gear 41, for motion or rotation transmitting engagement are meshed together or otherwise drivingly engaged or arranged with each other thereby to effect conjoint rotation of the shifting gear with the reduction gear, and in its displaced position the shifting gear is meshed in engagement with driven pinion gear 57, as previously mentioned. In this manner when shifting gear 69 is axially moved into its displaced position between reduction gear 41 and driven pinion gear 57, the operation of gear train 23 is changed or translated from the slow speed mode to the fast speed mode thereof, and fast speed branch 29 of the gear train is actuated or driven. Thus, fast speed branch 29 is driven by motor pinion 31 through idler gear 33, clutch gear 37, reduction gear 41, pinion gear 61 and segmented gear 59, and shifting gear 69 is conjointly rotatable with reduction gear 41 and meshed with driven pinion gear 57. As previously mentioned, gear 61 is meshed in engagement with segmented gear 59 to effect the conjoint rotation thereof with camming means 25 through one revolution thereof, and at the end of such one revolution, sector 67 on the segmented gear is run out of meshing engagement with gear 61 thereby to interrupt, at least momentarily, the driven association of the segmented gear with gear 61. Of course, upon this interruption of the driven association between segmented gear 59 and pinion gear 61, the conjoint rotational movement of the segmented gear and camming means 25 are terminated, and such termination predetermines the position or location of the camming means at the end of one complete revolution thereof.

It may be noted that the engagement of shifting gear 69 in its displaced position with driven pinion gear 57 effects the driven rotation thereof at a greater speed or rate than that discussed hereinabove when the driven pinion gear was operated in the slow speed mode of gear train 23. Therefore, driven pinion gear 57 drives clutch gear 53 at a greater speed than it can be driven through low speed branch 27, and as a result, clutch spring 55 is loosened or slips about shaft 51 thereby to clutch or otherwise release the clutch gear from the driven engagement thereof with idler gear 49. In this manner, clutch spring 55 is effective to cause the release or disablement of at least a part of slow speed branch 27, i.e., reduction gear 45 and idler gear 49, as previously mentioned, when driven pinion gear 57 is driven in the fast speed mode of drive train 23. It may also be noted that when the conjoint rotational movement of segmented gear 59 and camming means 25 is interrupted and terminated, as discussed above, the driven rotation relative thereto of driven pinion gear 57 is continued through its engagement with shifting gear 69 in the fast speed mode of drive train 23. Therefore, abutment 63 on driven pinion gear 57 is rotated or otherwise moved therewith toward abutment or driving engagement with abutment 65 on segmented gear 59 in the rotation terminated position thereof. It may be noted that the rotation of abutment 63 on driven pinion gear 57 into abutting engagement with abutment 65 associated with segmented gear 65 acts to nudge or otherwise move sector 67 of the segmented gear past pinion gear 61 and thereby to reset or replace the segmented gear in meshing engagement with pinion gear 61. In other words, when abutments 63, 65 are engaged, driven pinion gear 57 effects the conjoint rotation of segmented gear 59 and camming means 23 from the rotational movement termination position thereof through sector 67 of the segmented gear and resets the segmented gear meshing it again in engagement with pinion gear 61. Thus, upon the nudging of camming means 23 past the preselected rotated position thereof, it may also be noted that the driven association between segmented gear 59 and pinion gear 61 in fast speed branch 29 of gear train 23 is reinitiated or reestablished with the segmented gear and camming means 23 being adapted for conjoint rotation through a successive revolution thereof. While the foregoing discusses the operation of gear train 23 in the slow speed mode and the fast speed mode thereof separately, it is to be understood that the gear train may be intermittently driven in either of such modes and that one or the other of such modes may be effected during the operation of the gear train as discussed in greater detail hereinafter. In the event it is desirable to manually advance or reset camming means 25, a manual force may be applied onto shaft 47, and it may be noted that clutch devices 37, 39 and 53, 55 operate to accommodate such manual applied force.

Figure 1:
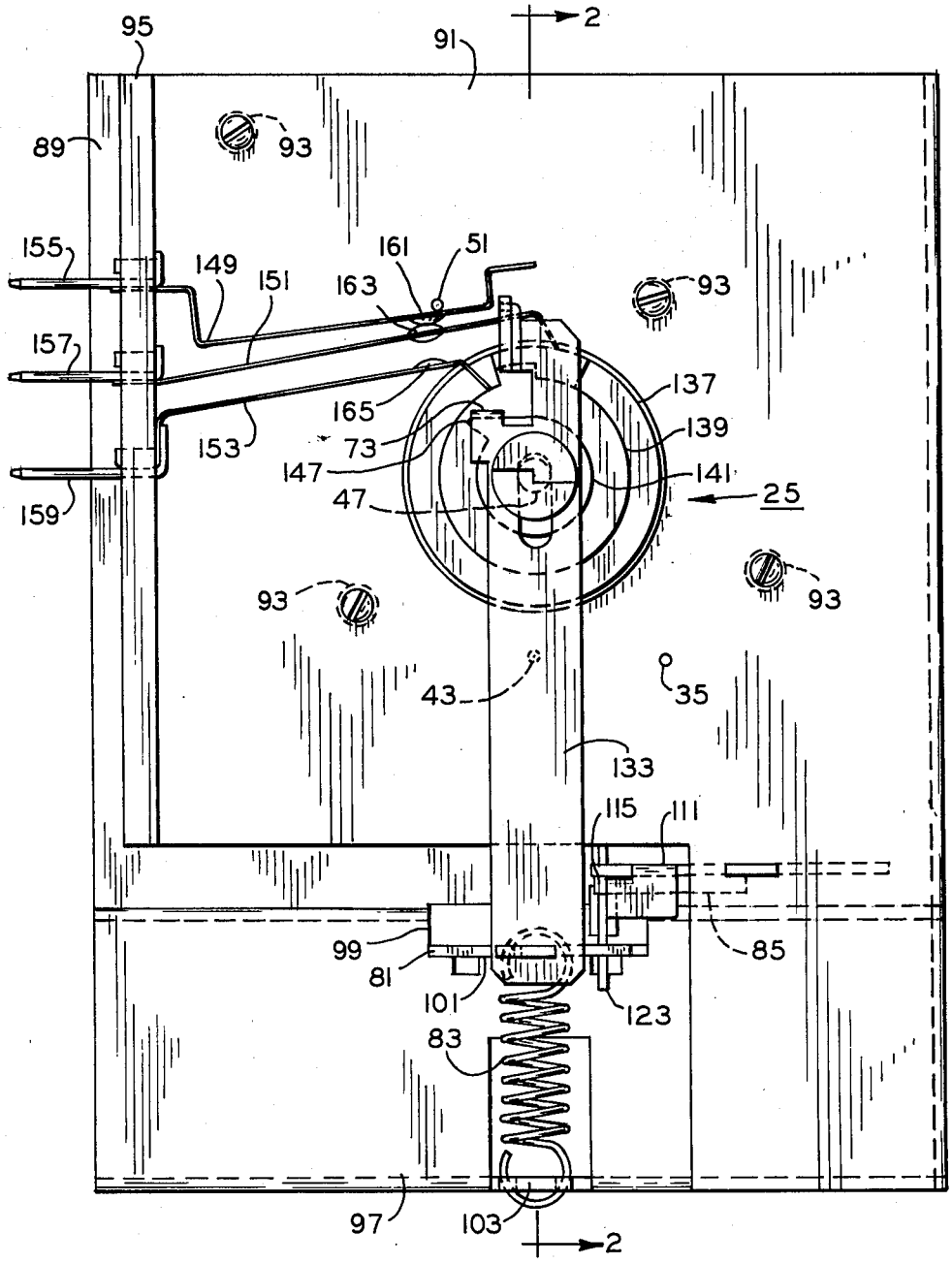
FIG. 1 is a front elevational view of a defrost control device in one form of the invention.

A translating means, indicated generally at 71 in FIG. 2 is provided for translating or otherwise effecting the transition of gear train 23 between its preselected speed modes and includes shifting gear 69. A part of translating means 71, such as for instance a cam follower 73 or the like as best seen in FIG. 1, is arranged in following engagement with camming means 25, and during a preselected part or portion of each revolution of the camming means, the translating means is cammed or otherwise actuated thereby toward a position adapted to effect the transition or translation of gear train 23 from the slow speed mode to the fast speed mode thereof. A retaining or maintaining means, such as an electromagnet or holding relay 75 for instance, is operable in response to the occurrence of a preselected condition, as discussed in detail hereinafter, and the electromagnet includes an energizable coil 77 and a pole piece 79. In the event of the occurrence of the aforementioned preselected condition when translating means 71 is cammed into its transition effecting position, coil 77 is energized to effect the magnetization of pole piece 79, and resiliently urged means, such as a pivoted lever or armature 81, which is at least in part common to both electromagnet 75 and the translating means, is attracted into magnetic holding engagement with the magnetized pole piece. It may be noted that the holding engagement between pole piece 79 and armature 81 retains or otherwise maintains translating means 71 in its translation effecting position so long as the preselected condition occurs and even after camming means 25 is rotated past the preselected portion of the revolution thereof so as to be out of camming engagement with cam follower 73 of the translating means. In this manner, the operation of translating means 71 toward the translation effecting position results in the axial movement of shifting gear 69 on shaft 43 to shift the operation of gear train 23 from the slow speed mode to the fast speed mode thereof, as discussed above, and a resilient means, such as a spring 83 for instance, is associated with armature 81 so as to define biasing means opposing the movement of translating means 71 toward its translation effecting position. To conclude the discussion of the method of operating defrost control device 21, it may be noted that means, such as a bimetal element 85 or the like for instance as best seen in FIGS. 3 and 6, is operable generally upon the occurrence of another preselected condition for blocking the operation of translating means 71 thereby to disable it and obviate shifting of drive train 23 into its fast speed mode, as discussed in greater detail hereinafter.

Referring again to the drawings in general and recapitulating at least in part with respect to the foregoing, defrost control device 21 in one form of this invention is provided with camming means 25 for rotational movement, and gear train means 23 is operable generally in a pair of preselected speed modes for effecting the rotational movement of the camming means (FIGS. 1–5). Translating means 71 is actuated toward its transition or displaced position by camming means 25 during a part of the rotational movement thereof and is adapted for translating or otherwise changing gear train means 23 from one of the preselected speed modes to the other of the preselected speed modes thereof (FIGS. 8–11). Means, such as electromagnet 75 for instance, is selectively operable upon the occurrence of a preselected condition for releasably maintaining or retaining translating means 71 in the displaced position thereof to effect the operation of gear train means in its other preselected speed mode (FIGS. 2 and 3).

More particularly and with specific reference to FIGS. 1–7, defrost control device 21 is provided with a housing 87 including at least a pair of opposite end plates or wall means 89, 91 retained in spaced apart relation by a plurality of posts 93 interposed between the end plates and fixedly secured thereto, and another wall means, such as an insulation plate 95 formed of a dielectric material or the like for instance, is fixedly secured to the end plates at least generally adjacent respective edges thereof. Opposite end portions of shafts 35, 43, 51 are rotatably received in end plates 89, 91, and one opposite end of shaft 47 is rotatably received in end plate 89 while the other opposite end thereof extends through camming means 23 which is rotatably received in end plate 91; therefore, drive train 23 is arranged or otherwise disposed generally between the end plates. A depending flange 97 is integrally provided on end plate 89, and both coil 77 and pole piece 79 of electromagnet 75 are secured by suitable means on the depending flange. As best seen in FIGS. 2 and 3, an opening 99 through flange 97 defines a pivot ledge or fulcrum 101 for armature 81 which extends through the opening, and a pair of oppositely extending tabs 103, 105 integral with the flange respectively define retainer means for spring 83 biased between the armature and tab 103 and stop means for engagement with the armature limiting its pivotal motion about fulcrum 101 in response to the compressive force of spring 83. A dynamoelectric machine or electric motor 107 and an associated speed or gear reduction device 109 are fixedly secured by suitable means to end plate 89 and are drivingly connected with input pinion gear 31 of gear train 23 thereby to comprise the drive or motive force therefor.

Figure 6:
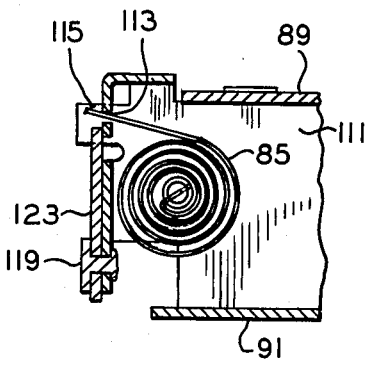

An intermediate or support plate 111 is fixedly secured by suitable means between end plates 89, 91, and a notch or opening 113 is provided in the support plate through which a free end 115 of bimetal element 85 extends with the bimetal element being secured by suitable means to the support plate, as best seen in FIGS. 3 and 6. Thus, upon expansive and contractive movement of bimetal element 85 in response to a preselected outdoor or atmospheric temperature condition, free end 115 of the bimetal element is movable in support plate opening 113 between a releasing position (as shown in dotted outline in FIG. 3) and a blocking position, as discussed in detail hereinafter. A lever 117 is pivotally secured by a pivot pin 119 to support plate 111 generally adjacent opening 113 therein, and the lever includes a pair of arms 121, 123. Lever arm 121 is operatively associated or otherwise connected with shifting gear 69 to effect the axial movement thereof on shaft 43 of drive train 23 in response to pivotal movement of the lever, and a cam follower, such as a tab 125 or the like for instance, on the free end of the lever arm is arranged in following engagement with groove 58 and land **58*a* in driven pinion gear 57 of the gear train, as best seen in FIG. 5 and as discussed hereinafter. Resilient means, such as a coil spring 127 for instance, is disposed about shaft 43 and biased between pinion gear 61 thereof and shifting gear 69 so as to bias it and lever 121 in a direction urging the shifting gear toward its displaced position and urging tab or cam follower 125 on lever arm 121 toward following engagement with cam groove 58 and land 58*a* of driven pinion gear 57. Lever arm 123 is provided with a pair of abutments 129, 131 respectively adapted to engage with free end 115 of bimetal 85 and armature 81. Thus, when abutment 131 of lever arm 123 is engaged with armature 81, the compressive force of armature spring 83 pivotally urges lever 117 in a direction about pivot pin 119 so as to bias shifting gear 69 against the compressive force of spring 127 and against movement of the shifting gear toward its displaced position. Further, cam follower 125 on lever arm 123 is also urged toward a position disengaged from cam groove 58 and land 58*a* of driven pinion gear 57 in response to the compressive force of armature spring 83. In the event of the occurrence of the forementioned preselected outdoor temperature condition, bimetal element 85 is responsive thereto to effect the movement of its free end 115 toward its blocking position adapted to engage with abutment 129 on lever arm 123 thereby to obviate or block pivotal movement of lever 117 about its pivot pin 119. Thus, it may be noted that armature 81 and spring 83 and also lever 117 and spring 127 define a pair of resiliently urged means releasably engaged with each other for controlling the operation of shifting gear 69. A moving means, such as for instance a cam follower arm or connecting link 133 or the like, has one end thereof connected with armature 81, and cam follower or tab 73 for instance on the other opposite end of the connecting link is urged into following engagement with camming means 25 by the compressive force of armature spring 83. In view of the foregoing, it may be noted that translating means 71 comprises shifting gear 69, spring 127, lever 117, armature 81 of holding relay 75, spring 83 and connecting link 133**.

Camming means 25 has a plurality of cam surfaces including dwells or dwell surfaces 137, 139, 141 and rises or rise surfaces 143, 145, 147 thereon defining a plurality of cam surfaces and extending about preselected parts or portions of the camming means, respectively as best seen in FIGS. 1 and 9–12. Tab 73 of connecting link 133 is arranged in following engagement with cam surface 141, 147 of camming means 25. A plurality of means, such as switches or switch elements 149, 151, 153 for instance, are movable generally for switching between switching modes thereof, respectively, and switching means or switch elements 151, 153 are arranged in following engagement with cam surfaces 137, 143 and 139, 145 of camming means 25, respectively. Switch elements 149, 151, 153 may be formed of a resilient current carrying material, such as beryllium copper or the like for instance, and are mounted to a plurality of terminals 155, 157, 159 disposed in insulated plate 95 of housing 97, respectively. A plurality of contacts 161, 163, 165 are carried on switch elements 149, 151, 153, respectively, and in one switching mode or circuit making position of the switch blades, the contacts are broken or disengaged while in the other switching mode or circuit interrupting position of the switch elements such contacts are made or engaged. To complete the description of defrost control device 21, connecting link 133 of translating means 71 is provided with a pair of means, such as extensions or supports 167, 169 for instance, adapted for supporting or positioning engagement with switch elements 149, 151, respectively, when the translating means is in its transition effecting or displaced position during a preselected portion of the rotational movement of camming means 25 in order to maintain contacts 161, 163 of switch elements 149, 151 disengaged or broken from such other, as discussed hereinafter.

Figure 13:
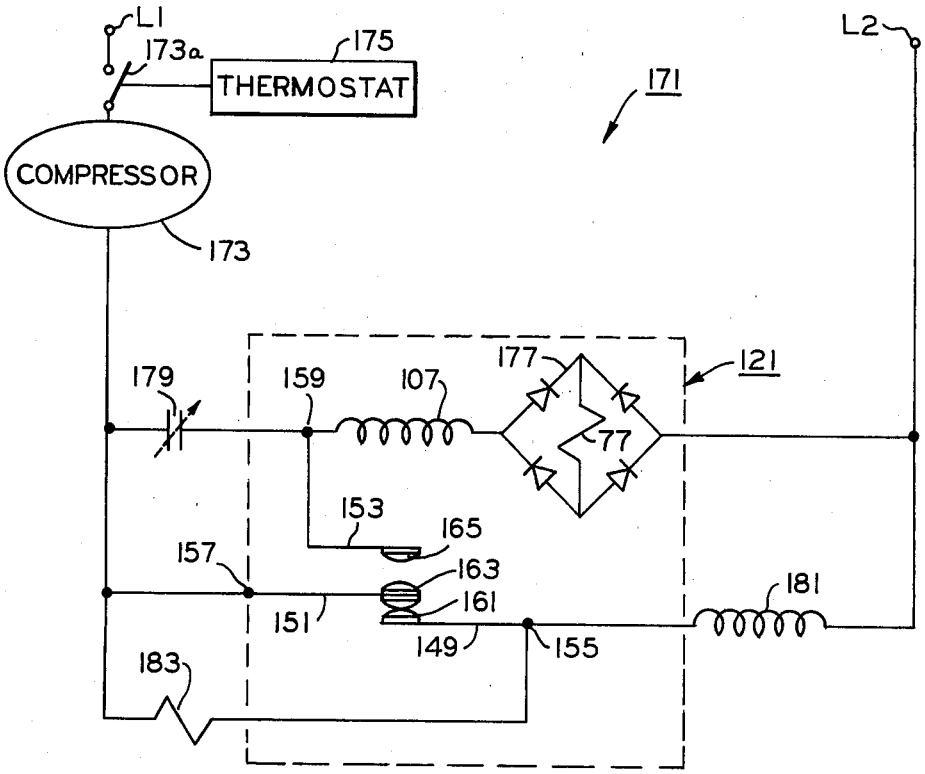
FIG. 13 is a schematic diagram of an exemplary circuit for controlling a conditioning system and illustrating principles which may be practiced in a method of operating or controlling a defrost cycle therefor also in one form of the invention.

Referring now to FIG. 13, defrost control device 21 is connected in an exemplary circuit 171 for controlling the operation of a conditioning system having a reversible heat pump (not shown) with an electric motor driven compressor 173 connected in series with a line terminal L1 of a pair thereof L1, L2. The heat pump may be a model BWB912A100A2 available from the General Electric Company, Tyler, Tex. Compressor 173 may be selectively energized in response to the operation of a contactor 173*a* by a thermostat 175 located so as to regulate the temperature of a selected space conditioned by the heat pump, and albeit not shown for purpose of drawing simplicity, the heat pump is provided with an indoor heat exchanger associated with the selected conditioned space, an outdoor heat exchanger and a reversing valve selectively operable to effect either heating or cooling modes of the heat pump. Thus, closing of contactor 173*a* by thermostat 175 effects the energization of compressor 173 and the enablement of circuit 171 across line terminals L1, L2. In defrost control device 21, coil 77 of electromagnet 75 is connected in a diode bridge circuit or rectifier 177, and the bridge circuit, electric motor 107 and a defrost terminating switch or temperature sensing means 179 are serially interconnected with each other across line terminals L1, L2. Defrost terminating switch 179 senses the temperature of the outside heat exchanger of the heat pump and in response thereto controls the energization of motor 107 and coil 77. Defrost terminating switch 179 may be a model 37T31 available from Therm-O-Disc, Inc., Mansfield, Ohio. The heat pump system is also provided with an outdoor fan motor 181 selectively energized to circulate outdoor air over the outdoor heat exchanger of the heat pump, and the outdoor fan motor is serially interconnected with a defrost relay 183 across line terminals L1, L2. The impedance of relay 183 in circuit 171 is predeterminately much greater than that of outdoor fan motor 181 and the relay may control the aforementioned reversing valve of the heat pump and/or the energization of an auxiliary heating system for the selected space being conditioned by the heat pump. Terminal 159 of defrost control device 21 is connected in circuit between defrost terminating switch 179 and motor 107, and terminal 157 of the defrost control device is connected to line terminal L1 while terminal 155 of the defrost control device is connected between outdoor fan motor 181 and relay 183.

Figure 8:
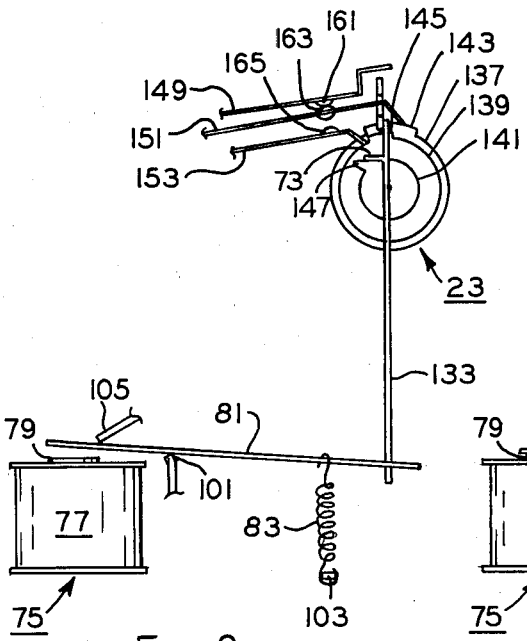
FIGS. 8–12 are schematic views illustrating the various switching modes of the defrost control device during the operation thereof.

In the operation of the conditioning or heat pump system associated with circuit 171, defrost termination switch 179 senses or monitors the temperature of the outdoor heat exchanger of the heat pump, and bimetal element 85 of defrost control device 21, which is also located outdoors at least generally adjacent the outdoor heat exchanger, senses or monitors the atmospheric or outdoor temperature. Thus, defrost termination switch 179 and bimetal element 85 of defrost control device 21 comprise a pair of means for sensing preselected conditions, i.e. the temperature of the outdoor heat exchanger and the outdoor temperature, respectively. Assuming camming means 25 has been driven to its preselected rotated position by gear train 23 of defrost control device 21, as illustrated in FIG. 8, switch element 151 is disposed in following engagement with rise 143 of camming means 25 while switch element 153 is disposed in following engagement with dwell 139 of the camming means thereby to disengage contacts 163, 165 of the switch elements, and the resiliency of switch element 149 urges its contact into making engagement with contact 163 of switch element 151. With switch elements 149, 151, 153 in these switching modes, assume that thermostat 175 is calling so as to effect the closure of contactor 173*a* thereby to energize compressor 173 and enable circuit 171 across line terminals L1, L2. When circuit 171 is so enabled, fan motor 181 is energized across line terminals L1, L2 through the circuit completing engagement of switch elements 149, 151 thereby to effect the circulation of outside air over the outside heat exchanger of the heat pump system. When the temperature of the outdoor heat exchanger sensed by defrost termination switch 179 is less than a preselected value (say 26° F. for example), the defrost termination switch will actuate to a closed position, as illustrated by the dashed arrow in FIG. 13, thereby to effect the energization of motor 107 and coil 77 of electromagnet 75, and the energization of motor 107 initiates the operation of gear train 23 of defrost control device 21 while the energization of coil 77 effects the establishment of a magnetic field by pole piece 79 of electromagnet 75. However with spring 83 biasing armature 81 about fulcrum 101 away from pole piece 79, the magnetic attraction between the pole piece and armature is not great enough to overcome the compressive force of the spring, as illustrated in FIG. 8. The speed mode at which gear train 23 of control device 21 is operated in response to the energization of motor 107 thereof is dependent upon the outdoor temperature sensed by bimetal element 85 of the defrost control device. Assuming the outdoor temperature is less than a preselected value (say 20° F. for instance), then the bimetal element 85 will cause its free end 115 to move toward or be disposed in its blocking position within notch 113 of support plate 111 so as to be engaged with abutment 129 on lever 117 of translation means 71, as best seen in FIG. 3. With free end 115 of bimetal element 85 so arranged in blocking engagement with abutment 129 on lever 117, pivotal movement of the lever about its pivot pin 119 to effect movement of shifting gear 69 toward its displaced position is obviated, and therefore, gear train 23 is operated in its slow speed mode, as discussed hereinbefore in detail.

Figure 9:
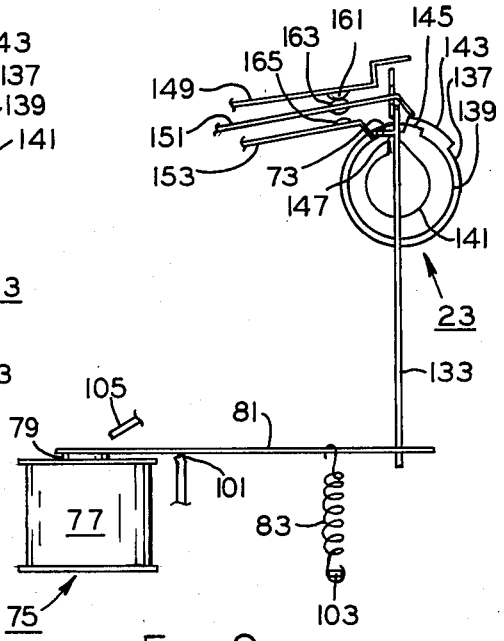

Upon the rotatable movement of camming means 25 to the rotated position thereof shown in FIG. 9, rise 147 of the camming means in engagement with cam follower 73 on connecting link 133 effects the camming actuation of the connecting link and armature 81 against the compressive force of spring 83 thereby to pivot the armature about fulcrum 101 into magnetic holding engagement with pole piece 79 of electromagnet 75 which is energized across line terminals L1, L2, as previously mentioned. Upon this camming movement of armature 81 into magnetic holding engagement with pole piece 79, the armature disengages abutment 131 of lever 117; however, since free end 115 of bimetal element 85 is in blocking engagement with abutment 129 of the lever, pivotal movement of the lever by spring 127 is obviated, as previously mentioned.

Figure 10:
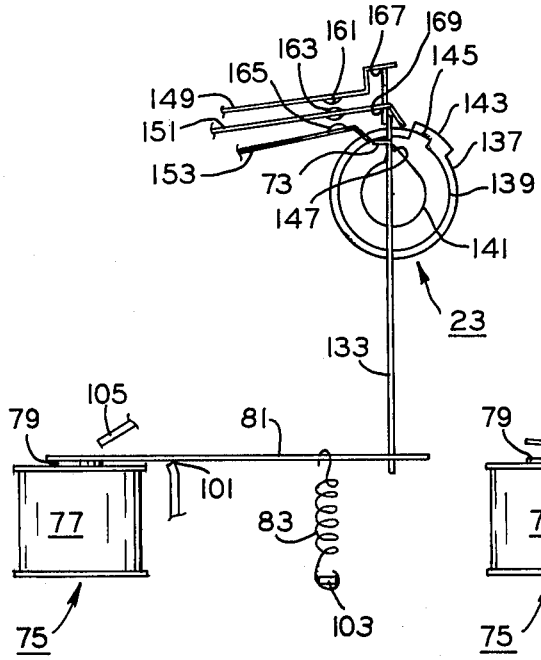

When gear train 23 operating in its slow speed mode revolves camming means 25 to the rotated position thereof shown in FIG. 10, switch element 151 drops off rise 143 onto support 169 of connecting link 133 thereby to space switch element 151 from contact with dwell 137 of the camming means, and switch element 149 is resiliently urged into engagement with support 167 therefor on the connecting link. At this time, the contacts 161, 163, 165 of switch elements 149, 151, 153 are disengaged from each other, and with the switch elements in this particular switching mode, defrost relay 183 is energized in circuit 171 across line terminals L1, L2 thereby to effect the operation of the reversing valve of the heat pump to initiate defrosting of the outdoor heat exchanger of the heat pump system. While defrost termination switch 179, motor 107 and coil 77 remain energized across line terminals L1, L2 upon the energization of defrost relay 183, it may be noted that outdoor fan motor 181 becomes deenergized upon the breaking of contacts 161, 163 on switch elements 149, 151 since the impedance of defrost relay 183 is much greater than that of the oudoor fan motor, as previously mentioned.

Figure 11:
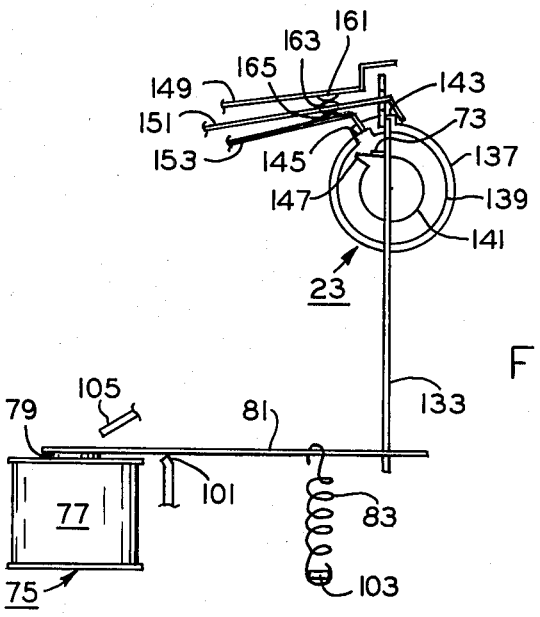

With defrost relay 183 energized and outdoor fan motor 181 deenergized in the manner discussed above, the heat pump system is in the defrost mode thereof and may remain in such defrost mode during the remainder of the revolution of camming means 25 by drive train 23 of defrost control device 21. When camming means 25 approaches the completion of one revolution thereof, as illustrated in FIG. 11, rise 145 of the camming means engages switch element 153 lifting or displacing it so as to remake contacts 161, 163, 165 and thereby also lift switch elements 149, 151 from their engagements with supports 167, 169 of connecting link 133. Upon this camming movement of switch elements 149, 151, 153 into these particular switching modes thereof, as shown in FIG. 10, defrost relay 183 is deenergized or again shunted in circuit 171 by the making of the switch elements which effects the reenergization of outdoor fan motor 181 across line terminals L1, L2. Of course, the deenergization of defrost relay 183 effects the operation of the reversing valve of the heat pump, and the reenergization of outdoor fan motor 181 again effects the circulation of atmospheric air over the outside heat exchanger.

When camming means 25 has been rotated one revolution thereby by gear train 23 of defrost control device 21, the camming means is returned to the preselected rotated position thereof, as illustrated in FIG. 8. At this time, rise 143 of camming means 23 is rotated into engagement with switch member 151 wherein contacts 161, 163 of switch members 149, 151 remain engaged, and rise 145 is rotated from engagement with switch member 153 causing it to drop or fall into engagement with dwell 139 of the camming means. Thus, upon the completion of one revolution of camming means 25, switch elements 149, 151, 153 are returned to the original switching modes thereof, as discussed hereinbefore. Of course, if defrost termination switch 179 remains energized upon the completion of one revolution of camming means 25, gear train 23 of defrost device 21 will then continue to drive the camming means through at least a part of a successive revolution thereof, as discussed hereinbefore.

Figure 12:
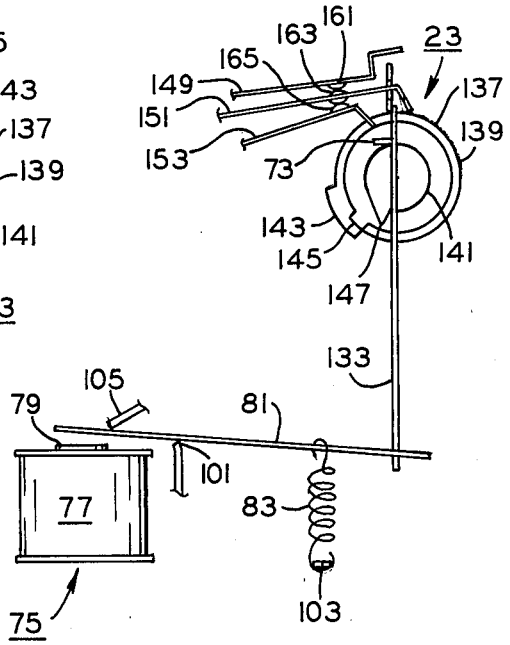

Defrost termination may, of course, occur during any part of the revolution of camming means 25. Assume, for instance, that defrost termination switch 179 senses a temperature of the outdoor heat exchanger in excess of the aforementioned preselected value when camming means is in the portion of the revolution thereof illustrated in FIG. 10. In this event, defrost termination switch 179 will reopen effecting the deenergization of motor 107 and coil 77 in diode bridge circuit 171 across line terminals L1, L2. As a result, deenergization of motor 107 effects the interruption of the operation of gear train 23 in defrost control device 21 and deenergization of coil 77 thereof effects the demagnetization of pole piece 79 in electromagnet 75 thereby to interrupt the magnetic holding engagement of armature 81 therewith. Upon the interruption of the magnetic holding engagement between pole piece 79 and armature 81, the compressive force of spring 83 pivots the armature about fulcrum 101 so as to return the armature and connecting link 133 to their original positions reengaging cam follower 73 on the connecting link into following engagement with dwell 141 on camming means 25 as illustrated in FIG. 12. Upon this return movement of connecting link 133 to its original position, supports 167, 169 of the connecting link are disengaged from switch elements 149, 151, and the resiliency of switch elements 149, 151 effects the making of their contacts 161, 163 and the making of contact 163 with contact 165 of switch element 153 which is supported in following engagement on dwell 139 of camming means 25. With switch elements 149, 151, 153 so made, motor 107 and coil 77 of defrost control device 21 are reenergized through made switch elements 151, 153 across line terminals L1, L2 in circuit 171, and outdoor fan motor 181 is also reenergized across the line terminals through made switch elements 149, 151 while defrost relay 183 is shunted so as to be deenergized in the circuit. The reenergization of motor 107 reinitiates the operation of gear train 23 in defrost control device 21 so as to continue the rotational movement of camming means 25 through its revolution, and the reenergization of outdoor fan motor 181 reestablishes the circulation of outside air over the outside heat exchanger of the heat pump. The shunting of defrost relay 183 effects the operation of the reversing valve of the heat pump to its original position to terminate defrosting of the outside heat exchanger, and the compressive force of spring 83 retains or maintains armature 81 in its original position displaced from pole piece 79 of electromagnet 75 even though coil 77 thereof is reenergized across line terminals L1, L2 in circuit 171, as previously discussed. In this manner, defrosting is terminated, but the aforementioned reinitiation of the operation of gear train 23 continues the rotational movement of camming means 25 through the rest of its revolution returning the camming means and switch elements 149, 151, 153 to the positions thereof shown in FIG. 8, as discussed hereinabove. With camming means 25 and switch elements 149, 151, 153 so returned to the FIG. 8 positions thereof completing the one revolution of the camming means and with defrost termination switch 179 open, the breaking of switch elements 151, 153 deenergizes motor 107 and coil 77 of defrost control device across line terminals L1, L2 in circuit 171 thereby to again interrupt the operation of gear train 23 with camming means 25 in its preselected rotated position.

The operation of gear train 23 in defrost control device 21 may be translated or changed from the slow speed mode to the fast speed mode thereof during the portion of the revolution of camming means 23 shown in FIG. 9 providing that defrost termination switch 179 senses a temperature of the outdoor heat exchager less than the aforementioned preselected value thereof and that bimetal element 85 of the defrost control device senses a temperature of the outside air more than the aforementioned preselected value thereof. Of course, when bimetal element 85 is subjected to atmospheric temperature more than the preselected value, it contracts so as to move or otherwise displace free end 115 thereof toward its releasing position in notch 113 of support plate 111 disengaged from abutment 129 of lever 117, as illustrated in dotted outline in FIG. 3. Thus, when defrost terminating switch 179 closes upon the sensing thereby of the temperature of the outside heat exchanger less than of the preselected value so as to effect the energization of motor 107 and coil 77 of defrost control device 21 across line terminals L1, L2 of circuit 171, the operation of gear train 23 is effected in the slow speed mode thereof to effect the rotational movement of camming means 25. Upon the rotation of camming means 25 to the position thereof shown in FIG. 9, rise 147 of the camming means in camming engagement with cam follower 73 of connecting link 133 cams or otherwise effects the movement of translating means 71 into the transition effecting position thereof. Upon this camming of translating means 71 toward its transition effecting position, armature 81 is pivoted about fulcrum 101 into magnetic holding engagement with pole piece 79 of electromagnet 77 against the compressive force of spring 83 thereby to release or disengage the armature from abutment 131 of lever 117. When lever 117 is so released by armature 81, the compressive force of spring 127 urges lever 117 about its pivot pin 119 in a direction to effect the axial movement of shifting gear 69 on shaft 43 leftwardly, as best seen in FIG. 3. This leftward or driven movement of shifting gear 69 engages hubs 68 thereon within recesses 70 of reduction gear 41 thereby to effect the conjoint driven rotation of the shifting gear with the reduction gear and also moves the shifting gear into meshing or driving engagement with driven pinion gear 57, as best seen in FIGS. 3 and 7. When shifting gear 69 is so meshed in engagement with driven pinion gear 57, gear train 23 is operating in the fast speed mode thereof, as discussed in detail hereinabove, and camming means 25 is rotated through its one revolution by the gear train returning the camming means to the position thereof as illustrated in FIG. 11. Upon the return of camming means 25 to the FIG. 11 position thereof, sector 67 of segmented gear 59 is run out of meshing engagement with gear 61 thereby to maintain camming means in its FIG. 11 position until abutment 63 on driven pinion gear 57 is revolved into engagement with abutment 65 associated with the segmented gear in order to nudge its sector 67 past gear 61 thereby to reengage the segmented gear in meshing engagement with gear 61, as discussed hereinabove. So long as defrost termination switch 179 remains closed and free end 115 of bimetal 85 is in its releasing position disengaged from lever 117, operation of gear train 23 in defrost control device 21 will be reinitiated in the manner discussed above during each revolution of camming means 25 by the gear train.

When shifting gear 69 is moved into its displaced position in driving engagement with driven pinion gear 57 upon the initiation of the fast speed mode operation of gear train 23, cam follower 125 of lever 117 is entered into cam groove 58 of the driven pinion gear. Generally as abutment 63 on driven pinion gear 57 is revolved into abutment or nudging engagement with abutment 65 associated with segmented gear 59, land **58*a* on the driven pinion gear engages cam follower 125 of lever 117 pivoting it about its pivot pin 119 against the compressive force of spring 127. This pivotal movement of lever 117 against spring 127 conjointly effects axial movement of shifting gear 69 from its displaced position toward its at-rest position on shaft 43 thereby to disengage the shifting gear from reduction gear 41 and driven pinion gear 57. Of course, as segmented gear 59 is subsequently nudged into meshing engagement with gear 61, as discussed above, to effect a successive rotation of camming means 25, the fast speed mode operation of gear train 23** may be again reinitiated in the same manner discussed hereinabove.

In the light of the foregoing, it may be noted that defrost control device 21 acting in combination with defrost termination switch 179 initiates and terminates the defrosting cycle of the heat pump when camming means 25 is in like positions thereof shown in FIGS. 10 and 11. Defrosting of the heat pump is then inhibited when camming means 25 is rotated to the position thereof illustrated in FIG. 12 and defrost termination switch 179 opens due to the temperature of the outdoor heat exchanger rising because frost is melted therefrom or else the camming means is rotated to the position thereof shown in FIG. 11 in response to the time override engagement of abutments 63, 65 on driven pinion gear 57 and segmented gear 59. When camming means 25 is in the FIG. 11 positions thereof, segmented gear 59 is at a standstill since sector 67 is run out of mesh with pinion gear 61, and the segmented gear will wait to be nudged by driven pinion gear 57, as discussed above.

From the foregoing, it is now apparent that a novel defrost control device and a novel method of operating such are presented meeting at least the objects and advantageous features set out hereinbefore, and it is contemplated that changes as to the precise arrangements, shapes, connections and details of the constructions illustrated herein by way of example for purposes of disclosure, as well as the precise steps and order thereof in the method, may be made by those having ordinary skill in the art without departing from the spirit of the invention or the scope thereof as defined by the claims which follow.

What we claim as new and desire to secure by Letters Patent of the United States is:

1. A defrost control device comprising:

a housing;

a plurality of means associated with said housing and movable for switching between switching modes thereof, respectively;

a first shaft rotatable in said housing and including a pair of reduction gears and another gear conjointly rotatable with said first shaft, respectively;

means rotatable in said housing for camming with at least some of said switching means to control the movement of said switching means between the switching modes thereof, respectively;

a segmented gear means conjointly rotatable with said camming means for meshing in engagement with said another gear on said first shaft and including a sector having a plurality of missing gear teeth and adapted to disengage from said another gear;

a second shaft rotatable in said housing and including an idler gear conjointly rotatable with said second shaft, a clutch gear rotatable about said second shaft and meshed in engagement with one of said reduction gears, and clutch means associated with said second shaft and said clutch gear for effecting conjoint rotation in only one direction of said clutch gear with said second shaft;

input pinion means rotatable in said housing for meshing engagement with said idler gear to effect the rotation thereof in the one direction;

a third shaft rotatable in said housing and said camming means and including a driven pinion gear conjointly rotatable with said third shaft;

another pair of reduction gears conjointly rotatable with each other about said third shaft, one of said reduction gears of said another reduction gear pair being meshed in engagement with the other of said reduction gears of said first named reduction gear pair on said first shaft;

a fourth shaft rotatable in said housing and including another idler gear conjointly rotatable with said fourth shaft and meshed in engagement with the other of said reduction gears of said another pair thereof, another clutch gear rotatable about said fourth shaft and meshed in engagement with said pinion gear, and another clutch means associated with said fourth shaft and said another clutch gear for effecting conjoint rotation of said another clutch gear with said fourth shaft in only another direction opposite the one direction;

a shifting gear rotatable about said first shaft and selectively axially movable thereon toward a shifted position in conjoint driven rotational engagement with said first named reduction gear pair and meshing in engagement with said driven pinion gear; and a pair of means associated with said driven pinion gear and said segmented gear means and movable into abutment for nudging said segmented gear means into meshing engagement with said another gear on said first shaft when said sector of said segmented gear means is disengaged from said another gear.

2. A defrost control device comprising:

a plurality of means movable generally for switching between switching modes thereof, respectively;

means rotatably movable for camming at least some of said switching means to effect the movement of said switching means between the switching modes thereof, respectively;

gear train means operable generally in different preselected speed modes for effecting the rotational movement of said camming means;

resiliently urged means movable toward a shifted position for enabling only a part of said gear train means to effect its operation in one of the preselected speed modes thereof;

means for biasing said resiliently urged means against movement toward its shifted position;

means actuated by said camming means during a portion of its rotatable movement for moving said biasing means toward a displaced position to effect the movement of said resiliently urged means toward its shifted position; and means selectively operable generally for releasably maintaining said biasing means in its displaced position.

3. A defrost control device as set forth in claim 2 further comprising means operable generally in the event of the occurrence of a preselected condition for blocking the movement of said resiliently urged means towards its shifted position when said biasing means is in its displaced position.

4. A defrost control device as set forth in claim 2 wherein said moving means includes means for supporting two of said switching means so as to disassociate them from said camming means during another portion of the rotatable movement of said camming means when said biasing means is in its displaced position.

5. A defrost control device as set forth in claim 2 wherein said gear train means includes means operable generally in response to the enablement of said only part of said gear train means for disabling another part thereof upon the movement of said resiliently urged means toward its shifted position.

6. A defrost control device comprising:

camming means for rotational movement;

gear train means operable generally in at least a pair of preselected speed modes for effecting the rotational movement of said camming means and including means movable toward a shifted position for shifting the operation of said gear train means from one of the preselected speed modes to the other of the preselected speed modes thereof;

a pair of resiliently urged means releasably engaged with each other and operable generally for controlling said shifting means, said resiliently urged means being operable when releasably engaged to retain said shifting means against movement toward its shifted position and one of said resiliently urged means being operable to effect the movement of said shifting means toward its shifted position when the releasable engagement between said resiliently urged means is interrupted; and means actuated by said camming means and operable generally for moving the other of said resiliently urged means toward a displaced position so as to interrupt the releasable engagement of said resiliently urged means.

7. A defrost control device as set forth in claim 6 further comprising means operable generally in response to the occurrence of a preselected condition for blocking the operation of said one resiliently urged means.

8. A defrost control device as set forth in claim 6 further comprising electromagnetic means, said other resiliently urged means including an armature of said electromagnetic means.

9. A defrost control device as set forth in claim 8 wherein said electromagnetic means includes means for coupling in magnetic holding relation with said armature upon the movement of said armature to its displaced position.

10. A defrost control device as set forth in claim 6 wherein said gear train means includes cam means associated in camming engagement with a part of said one resiliently urged means and operable generally for displacing said shifting means from its shifted position during a preselected position of the rotational movement of said camming means.

11. A defrost control device as set forth in claim 6 further comprising a plurality of means operable generally for switching between switching modes thereof, respectively, at least some of said switching means being associated in following engagement with said camming means during at least a portion of the rotational movement thereof so as to effect the switching modes of said switching means.

12. A defrost control device comprising:

a plurality of switch means movable for switching between a pair of switching modes, respectively;

means rotatably movable and operable generally for camming at least a pair of said switch means to effect the movement thereof with another one of said switch means between the switching modes thereof;

gear train means operable generally in at least a pair of preselected speed modes for effecting the rotation of said camming means and including means movable toward a shifted position for shifting said gear train means from one of the preselected speed modes to the other of the preselected speed modes thereof, said camming means being operable during a portion of each revolution thereof to urge said at least switch means pair and said another one switch means into one of the switching modes thereof, and during another portion of each revolution thereof to effect the movement of one of said switch means of said at least switch means pair into the other of the switching modes and during still another portion of each revolution thereof effect the return of said another one switch means and the other of said switch means of said at least switch means pair into the one switching mode with said one switch means;

means arranged in following engagement with said camming means and actuated thereby toward a displaced position for effecting the movement of said shifting means toward its shifted position to change the gear train means into its other preselected speed mode during at least a part of the first named portion of each revolution of said camming means;

means selectively operable for retaining said movement effective means in its displaced position; and means on said movement effecting means for supporting said another one switch means and said other switch means in the other switching mode thereof during at least a part of the still another portion of each revolution of said camming means when said gear train means is in the other preselected speed mode thereof.

13. A defrost control device comprising:

a plurality of means movable for switching between switching modes thereof;

means rotatably movable for camming said switching means to control the movement of said switching means between the switching modes thereof;

a gear train operable generally in a pair of preselected speed modes and having a pair of branches selectively associated with said camming means to effect the rotatable movement thereof, said branches including means adapted for interrupting the rotatable movement of said camming means generally upon each revolution thereof, and means for resetting said camming means to reinitiate its rotatable movement upon the operation of said interrupting means;

means actuated toward a displaced position by said camming means upon the rotatable movement thereof for translating said gear train between the preselected speed modes thereof; and means associated with at least a part of said translating means and selectively operable for maintaining said translating means in the displaced position thereof.

14. A method of operating a defrost control device having gear train means for operation in a pair of preselected speed modes and also having a camming means associated with the gear train means for rotational movement thereby, the method comprising the steps of:

operating the gear train means in either of the preselected speed modes thereof and effecting the rotational movement of the camming means;

interrupting the association between the camming means with the gear train means and terminating the rotational movement of the camming means upon each revolution thereof; and resetting the camming means in the association thereof with the gear train means subsequent to the interruption of the association therebetween and reinitiating the rotational movement of the camming means when the camming means is reset in the association thereof with the gear train means.

15. The method as set forth in claim 14 wherein the operating step includes releasing at least a part of the gear train means from its association with the camming means when the gear train means is operated in one of the preselected speed modes thereof.

16. The method as set forth in claim 14 wherein the gear train means includes means for shifting from one of the preselected speed modes to the other of the preselected speed modes of the gear train means and wherein the operating step includes shifting the shifting means into an operative position in the gear train means.

17. The method as set forth in claim 16 wherein the gear train further includes a one way clutch mechanism and wherein the operating step further includes actuating the one way clutch mechanism and effecting the release of at least a part of the gear train means in response to the shifting step.

18. A method of operating a defrost control device having gear train means including a pair of branches operable in a pair of preselected speed modes, respectively, and the defrost control device also having camming means adapted for rotational movement, the method comprising the steps of:

effecting the operation of one of the branches of the gear train means in one of the preselected speed modes and interconnecting the camming means in driven association with the one branch of the gear train means so as to effect the rotation of the camming means in the one preselected speed mode;

rotating the camming means through at least a part of one revolution thereof generally into a preselected rotated position in response to the driven association of the camming means with the one branch;

interrupting the driven association between the camming means and the one branch upon the rotation of the camming means into the preselected rotated position thereof;

nudging the camming means past the preselected rotated position thereof subsequent to the interruption of the driven association between the camming means and the one branch; and reinitiating the driven association between the camming means and the one branch upon the nudging of the camming means past the preselected rotated position thereof.

19. The method as set forth in claim 18 wherein the gear train means further includes a segmented gear drivingly associated with the camming means and having at least one sector with a plurality of missing gear teeth, and gear means for meshing in engagement with said segmented gear, and wherein the interrupting step includes driving the segmented gear through the gear means toward the preselected rotated position of the camming means and presenting the at least one sector of the segmented gear to the gear means generally at the preselected rotated position of the camming means to effect the interruption of the driven association between the camming means and the one branch.

20. The method as set forth in claim 19 wherein the gear train means further includes another gear, abutment means associated with the another gear for abutment with an abutment associated with the segmented gear, and wherein the nudging step comprises moving the abutment means into driving engagement with the abutment and rotating the at least one sector of the segmented gear past the gear means.

21. The method as set forth in claim 20 wherein the reinitiating step includes remeshing the segmented gear and the gear means in engagement with each other.

22. The method as set forth in claim 18 wherein the gear train means further includes at least one clutch mechanism and wherein the effecting and interconnecting step includes releasing at least a part of the other of the branches of the gear train means from driving association in the other of the preselected speed modes with the camming means through the at least one clutch mechanism when the operation of the one branch is effected.

23. The method as set forth in claim 18 wherein the gear train means further includes means for shifting from the one to the other of the preselected speed modes of the gear train means and wherein the effecting and interconnecting step comprises shifting the shifting means into a position in association with the one branch of the gear train means so as to effect the operation thereof in the one preselected speed mode.

24. A method of operating a defrost control device with the device having gear train means adapted for operation in a pair of preselected speed modes and including a pair gear train branches, and means for translating the gear train means from one of the preselected speed modes to the other of the preselected speed modes thereof, a segmented gear having at least one sector with a plurality of missing teeth, and gear means for meshing in engagement with the segmented gear, and the device also having camming means adapted for rotation in driven association with the segmented gear and arranged in camming engagement with the translating means, and means selectively operable for retaining association with a part of the translating means, the method comprising the steps of:

operating one of the branches of the gear train means so as to effect conjoint driven rotation of the segmented gear in the one branch in one of the preselected speed modes and rotating the camming means through at least a part of one revolution thereof conjointly with the segmented gear;

running the at least one sector of the segmented gear out of meshing engagement with the gear means as the camming means is rotated through the at least part of the one revolution thereof and interrupting thereby the conjoint driven rotation of the gear means and the segmented gear as well as the rotation therewith of the camming means;

nudging the at least one sector of the segmented gear past the gear means and resetting thereby the segmented gear in the meshing engagement thereof with the gear means;

engaging the camming means with another part of the translating means during a part of a successive one of the revolutions of the camming means and camming the translating means toward a displaced position adapted to effect the operation of the other of the branches of the gear train means in the other of the preselected speed modes thereof;

effecting the selective operation of the retaining means into the association thereof with the first named part of the translating means upon the occurrence of a preselected condition and maintaining thereby the translating means in the displaced position thereof so as to effect the operation of the gear train means in the other preselected speed mode thereof;

continuing the conjoint driven rotation of the gear means and the segmented gear through the other branch in the other preselected speed mode of the gear train means so as to effect the rotational movement therewith of the camming means during the successive one of the revolutions thereof and releasing at least a part of the one branch from its operation in the gear train means.

25. A method of operating a defrost control device with the defrost control device including gear train means adapted for operation in a pair of preselected speed modes and having a pair of gear train branches, a clutch device, means for translating the gear train means to shift from one of the preselected speed modes to the other of the preselected speed modes thereof, a segmented gear having at least one sector with a plurality of missing teeth, gear means for meshing with the segmented gear, camming means for conjoint rotational movement with the segmented gear, a driven pinion gear, a pair of means associated with the segmented gear and the driven pinion gear and adapted for abutment, and means for retaining association with the translating means, the method comprising the steps of:

driving one of the branches of the gear train means to effect the operation of the gear train means in one of the preselected speed modes thereof and engaging the abutment means so as to effect the conjoint rotational movement of the driven pinion gear and the segmented gear through at least a part of one revolution of the camming means;

engaging the camming means with the translating means and camming the translating means toward a displaced position adapted to effect the operation of the other of the branches shifting the gear train means into the other of the preselected speed modes thereof;

effecting the selective operation of the retaining means into the association thereof with the translating means upon the occurrence of a preselected condition and maintaining thereby the translating means in its displaced position;

actuating the clutch device in response to the operation of the other branch of the gear train means so as to effect the release of at least a part of the one branch from its operation in the gear train means;

running the at least one sector of the segmented gear out of meshing engagement with the gear means and terminating the conjoint rotation of the segmented gear and the camming means;

moving one of the abutment means relative to the other of the abutment means at least upon the termination of the conjoint rotation of the segmented gear and the camming means and effecting the reengagement of the abutment means; and nudging the at least one sector of the segmented gear past the gear means in response to the reengagement of the abutment means and resetting the segmented gear in meshing engagement with the gear means.

26. A defrost control device comprising:

camming means for rotational movement;

gear train means operable generally in a pair of preselected speed modes for effecting the rotational movement of the camming means;

means actuated by said camming means during a part of the rotational movement thereof toward a displaced position and adapted for translating the gear train means from one of the preselected speed modes to the other of the preselected speed modes thereof; and means operable upon the occurrence of a preselected atmosphere condition for releasably maintaining said translating means in the displaced position thereof to effect the operation of said gear train means in its other preselected speed mode.

27. A defrost control device comprising:

camming means for rotational movement;

gear train means operable generally in at least a pair of preselected speed modes for effecting the rotational movement of said camming means and including a segmented gear drivingly associated with a part of said camming means and having at least one sector with a plurality of missing teeth to effect disengagement of said segmented gear from said gear train means to interrupt the rotational movement of said camming means during at least a part of each revolution thereof, and means for reinitiating the rotational movement of said camming means by said gear train means subsequent to the interruption of the rotational movement thereof; and means operable generally for shifting the operation of said gear train means between the preselected speed modes thereof.

28. A defrost control device as set forth in claim 27 wherein said reinitiating means includes a gear driven in said gear train means in relative relation to said segmented gear at least during the driven disengagement thereof from said gear train means, and a pair of means associated with said gear and said segmented gear for engagement in response to the driven relative relation thereof so as to nudge said segmented gear and said at least one sector thereof toward a position resetting said segmented gear in driven engagement in said gear train means.

29. A defrost control device as set forth in claim 27 wherein at least a part of said reinitiating means includes means for displacing said shifting means toward a position disengaged from said gear train means so as to effect its operation in one of the preselected speed modes thereof upon the interruption of the rotational movement of said camming means during the at least part of each revolution thereof.

* * * * *